US005998923A

United States Patent [19]

Jäger

[11] Patent Number: 5,998,923

[45] Date of Patent: Dec. 7, 1999

[54] LATERAL DEVIATION FLAT DISPLAY SCREEN

[75] Inventor: Axel Jäger, Sussargues, France

[73] Assignee: Pixtech S.A., Rousset, France

[21] Appl. No.: 08/968,228

[22] Filed: Nov. 12, 1997

[30] Foreign Application Priority Data

Nov. 22, 1996 [FR] France ..... 96 14616

[51] Int. Cl.[6] ..... H01J 1/62

[52] U.S. Cl. ..... 313/495; 313/497; 313/309; 313/336; 313/351

[58] Field of Search ..... 313/495, 496, 313/497, 309, 310, 351, 336

[56] References Cited

U.S. PATENT DOCUMENTS 5,561,345 10/1996 Kuo ..... 313/495
5,754,001 5/1998 Ohno et al. ..... 313/497

*Primary Examiner*—Ashok Patel
*Attorney, Agent, or Firm*—Arthur L. Plevy

[57] ABSTRACT

The present invention relates to a flat display screen including a cathode associated with a grid for extracting electrons emitted by at least one region of the cathode, and an anode provided with phosphor elements placed facing the cathode/grid, the cathode having no emissive region in the areas located above the phosphor elements, these areas including a conductive layer which can be biased independently from the emissive regions.

10 Claims, 2 Drawing Sheets

LATERAL DEVIATION FLAT DISPLAY SCREEN

BACKGROUND OF THE INVENTION

1. Field of the Invention

The present invention relates to flat display screens, and more specifically to so-called cathodoluminescence screens, the anode of which supports phosphor elements likely to be energized by electron bombardment. This electron bombardment can come from microtips, from layers of low extraction potential, or from a thermo-ionic source.

To simplify the present description, only color microtip screens will be considered hereafter, but it should be noted that the present invention relates, generally, to the several above-mentioned types of screens and the like, be they color or monochrome screens.

2. Discussion of the Related Art

FIG. 1 partially and schematically shows the structure of a conventional flat color microtip screen of the so-called "switched anode" type.

Such a screen is essentially formed of a cathode 1 with microtips 2 and of a grid 3 provided with holes 4 corresponding to the locations of microtips 2. Cathode 1 is placed facing a cathodoluminescent anode 5, a glass substrate 6 of which generally forms the screen surface.

The operating principle and an example of embodiment of a microtip screen are described in U.S. Pat. No 4,940,916 of the Commissariat à l'Energie Atomique.

The cathode is generally organized in columns and is formed, on a glass substrate 10, of cathode conductors organized in meshes from a conductive layer. Microtips 2 are provided on a resistive layer 11 deposited on the cathode conductors and are arranged within the meshes defined by the cathode conductors. FIG. 1 partially shows the inside of a mesh and the cathode conductors do not appear on the drawing. Cathode 1 is associated with grid 3 organized in lines. The intersection of a line of the grid and of a column of the cathode defines a pixel.

This device uses the electric field created between cathode 1 and grid 3 to extract electrons from microtips 2. These electrons are then attracted by phosphor elements 7 of anode 5 if these elements are properly biased.

Anode 5 has alternate strips of phosphor elements 7*r*, 7*g*, 7*b*, each corresponding to a color (Red, Green, Blue). The strips are parallel to the cathode columns and are separated from one another by an insulator 8. Phosphor elements 7 are deposited on electrodes 9, formed of corresponding strips of a transparent conductive layer such as indium and tin oxide (ITO).

In such a so-called "switched anode" screen, the sets of red, green, blue strips are, in this example, alternatively biased with respect to cathode 1, so that the electrons extracted from the microtips 2 of a pixel of the cathode/grid are alternatively directed to the phosphor elements 7 corresponding to each of the colors.

In another type of conventional microtip screen, not shown, all phosphor elements of the anode are brought to a same potential independently from their color. In this case, each column of cathode 1 is divided into three sub-columns arranged, respectively, above the strips of phosphor elements of each color. These sub-columns are addressed sequentially to bombard the phosphor elements associated with each of the colors. Each pixel is divided into three sub-pixels defined by the respective intersections of a grid line with each of the sub-columns of the cathode. Since all phosphor elements of the anode are biased independently from their color, these phosphor elements may be deposited according to a pattern defining the pixels with, for each color, an area of phosphor elements of the corresponding color defining the sub-pixel facing the corresponding cathode sub-column.

A disadvantage of conventional screens, be they switched anode screens or not, is that the microtips progressively loose their emissivity. This phenomenon can be observed by measuring the current in the cathode conductors. As a result, the brightness of the screen progressively decreases.

SUMMARY OF THE INVENTION

The present invention aims at overcoming this disadvantage by making the microtip emissivity substantially constant.

The present invention also aims at providing a flat display microtip screen observable from the cathode side.

To achieve these objects, the present invention provides a flat display screen including a cathode associated with a grid for extracting electrons emitted by at least one region of the cathode, and an anode provided with phosphor elements placed facing the cathode/grid, the cathode having no emissive region in the areas located above the phosphor elements, these areas including a conductive layer which can be biased independently from the emissive regions.

According to an embodiment of the present invention, the screen includes a grid for deviating the electrons emitted by each emissive region of the cathode to at least one region of phosphor elements.

According to an embodiment of the present invention, the conductive layer is biased to a potential at most equal to a minimum potential of biasing of the emissive regions.

According to an embodiment of the present invention, the cathode and the extraction grid are supported by a transparent plate forming the display surface of the screen, the conductive layer being in a transparent material directly deposited on the plate.

According to an embodiment of the present invention, each emissive region of the cathode is associated with a region of phosphor elements, the deviation grid being biased to a potential lower than a minimum potential of biasing of the emissive regions.

According to an embodiment of the present invention, each emissive region of the cathode is associated with at least two regions of phosphor elements, the biasing potential of the deviation grid being a function of the region of phosphor elements to be energized while being lower than a minimum biasing potential of the emissive regions.

According to an embodiment of the present invention, all regions of phosphor elements of the anode are simultaneously biased.

According to an embodiment of the present invention, the anode is formed of at least two sets of alternate strips of phosphor elements, each set of strips being individually biased.

According to an embodiment of the present invention, the cathode is organized in columns, the extraction grid being organized in lines and each intersection of a line of the extraction grid with a column of the cathode defining an emissive region.

According to an embodiment of the present invention, the emissive regions are formed of microtips.

The present invention originates from an interpretation of the phenomena which cause the above-mentioned problems in conventional screens.

The inventors consider that these problems result, in particular, from a deposition on the cathode microtips of polluters resulting from ions emitted by the anode.

In a microtip screen, in operation, the most negative potential corresponds to the microtips which are, for example, in molybdenum (Mo). Now, the electron bombardment of the phosphor elements causes an ionic emission at the surface of these phosphor elements. These ions are emitted perpendicularly to the anode surface and pollute the microtips which are located above the bombarded phosphor elements.

Based on this analysis, the present invention provides to shift the microtips with respect to the perpendicular of the regions of phosphor elements that they are to bombard.

The foregoing objects, features and advantages of the present invention, will be discussed in detail in the following non-limiting description of specific embodiments made in connection with the accompanying drawings.

DETAILED DESCRIPTION

The present invention will be described hereafter in relation with embodiments applied to a color screen. However, it should be noted that the present invention also applies to monochrome screens.

Figure 1:
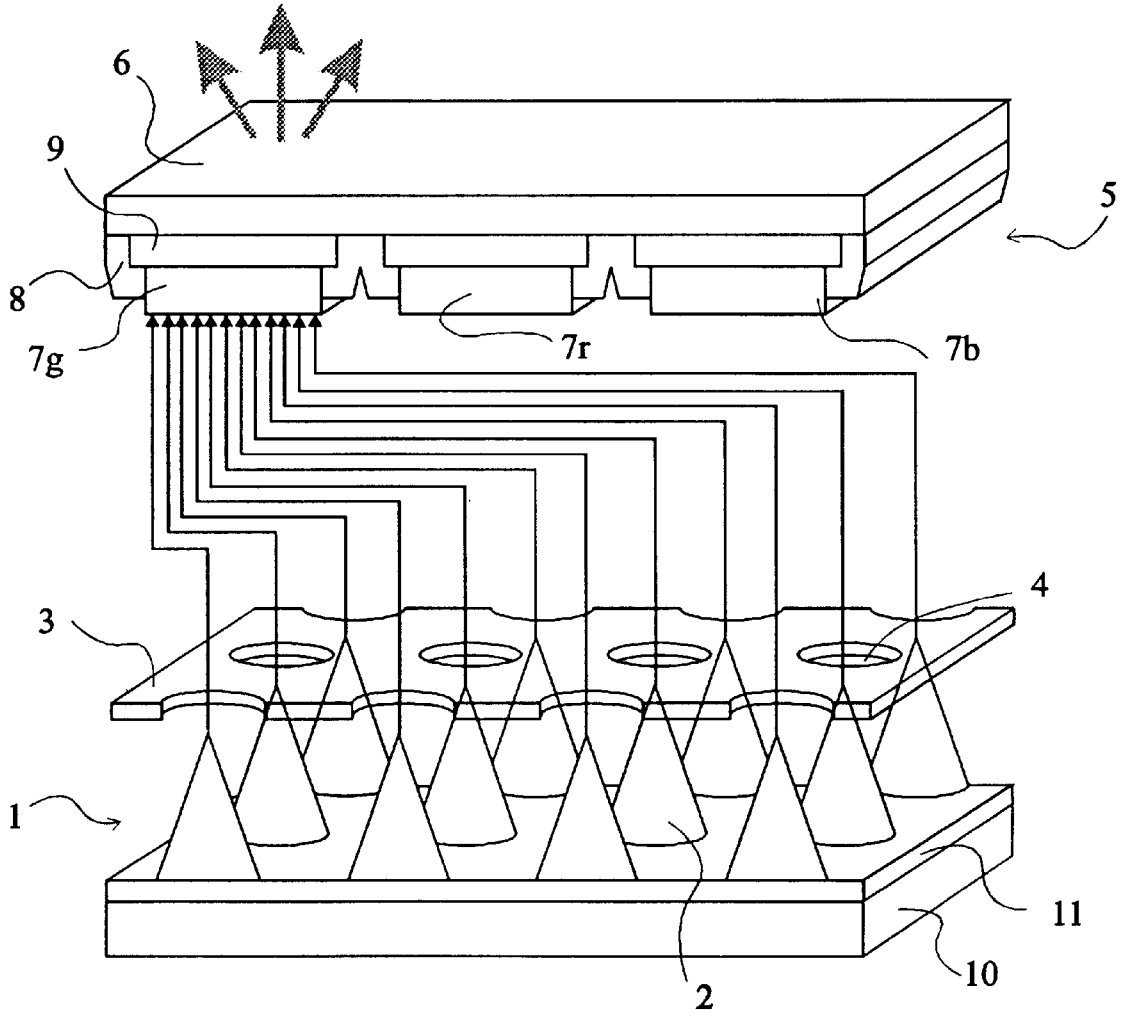
FIG. 1, previously described, is meant to show the state of the art and the problem to solve.
Figure 2:
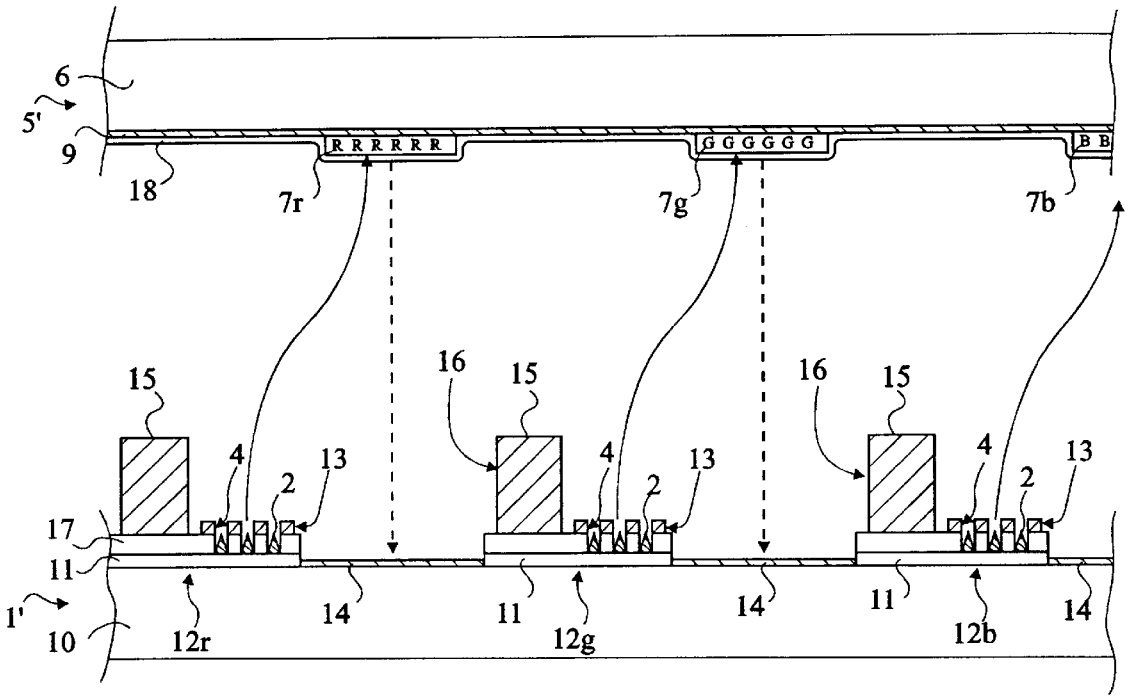
FIG. 2 shows in cross-sectional view a first embodiment of a flat display microtip screen according to the present invention.

FIG. 2 shows a first embodiment of a flat microtip display screen according to the present invention. This embodiment applies, more specifically, to a screen having all its phosphor elements simultaneously biased.

Conventionally, anode 5 of the screen is made on the internal surface of a plate 6, for example in glass. In the case of a color screen, regions, for example, parallel strips, of phosphor elements corresponding to each of the colors are deposited on a biasing conductive layer, for example, an ITO layer 9 extending across the entire internal surface of plate 6 corresponding to the useful area of the screen.

A cathode 1' according to the present invention is, as previously, provided on a plate 10, for example in glass. Cathode 1' is organized in columns and is, for example, formed of cathode conductors (not shown) organized in meshes from a conductive layer. Microtips 2 are implemented on a resistive layer 11 deposited on these cathode conductors and are arranged inside the meshes defined by the cathode conductors. In FIG. 2, only one column of cathode 1' has been shown. This column includes three sub-columns, respectively 12*r*, 12*g*, and 12*b*, associated with each of the colors. According to the present invention, each subcolumn 12*r*, 12*g*, or 12*b* is shifted from the perpendicular of the corresponding column of phosphor elements, respectively 7*r*, 7*g*, or 7*b*, while being parallel thereto.

Cathode 1' is associated with a grid 3 for extracting electrons, organized in lines. According to the present invention, grid 3 is provided not only with holes 4 corresponding to the locations of microtips 2, but also with a hole 13 of greater diameter at each intersection of a grid line with a strip 7 of phosphor elements of the anode. This hole 13 is meant for the passing of the ions emitted by the phosphor elements of the anode so that they are, according to the present invention, collected by a conductive layer 14 deposited between each sub-column of cathode 1'. Layer 14 is biased to a potential at most equal to the most negative biasing potential of the microtips (for example, 0 volt). Layer 14 thus can be biased independently from the microtip biasing conductors, organized in sub-columns 12*r*, 12*g*, 12*b*. Layer 14 has the function of avoiding that a positive charge area develops between two sub-columns of cathode 1', which would risk to cause the formation of electric arcs.

A pixel of a screen such as shown in FIG. 2 is formed of three sub-pixels respectively associated with each of the colors. Each sub-pixel is defined by the intersection of a line of extraction grid 3 with a sub-column 12*r*, 12*g*, or 12*b* of cathode 1' and a strip, respectively 7*r*, 7*g*, 7*b*, of anode 5'.

A characteristic of the present invention is that cathode 1' is associated with an additional grid 15 disposed on the entire surface of the screen and provided with holes 16 corresponding to the locations of each sub-pixel of the screen. The function of grid 15 is to laterally push away the electrons emitted by microtips 2 of a sub-pixel to the strip of phosphor elements of this sub-pixel. Grid 15 is brought to a negative potential selected, in particular, according to the desired deviation amplitude, that is, to the relative positions of the cathode sub-columns with respect to the strips of phosphor elements of the anode. Thus, in the case of an anode having all its phosphor elements simultaneously biased, it is guaranteed that the electrons emitted by a sub-column 12*r*, 12*g*, or 12*b* do bombard phosphor elements 7*r*, 7*g*, or 7*b* of the corresponding color.

Grid 15 is positioned on the cathode/grid assembly while being insulated from extraction grid 3. In the embodiment shown, the lines of grid 3 are provided with a hole 13 perpendicularly above each intersection of a line of grid 3 with a strip of phosphor elements of anode 5'.

To perform its deviating function, grid 15 can, as an alternative, be formed of strips parallel to the sub-columns of cathode 1', one strip of the deviation grid being associated with each sub-column while being opposite to this sub-column with respect to the perpendicular of the corresponding strip of phosphor elements. However, it is preferred, according to the present invention, to use a grid 15 forming a meshing with an opening 16 at the right of each sub-pixel. An advantage of such an embodiment is that grid 15 then has a focusing effect on the electrons towards the area of the strip of phosphor elements of anode 5' corresponding to the illuminated sub-pixel. This advantage is especially valuable for a screen of high inter-electrode voltage (for example, 2 to 10 keV) for which the inter-electrode distance then required risks to cause, for a grid 15 formed of simple strips, a parasitic illumination of the neighboring pixels along a same strip of phosphor elements.

The height of grid 15 is a function, in particular, of the inter-electrode distance and of the amplitude of the deviation desired for the electrons. As a specific example of implementation, grid 15 has a height of around 50 to 200 $\mu$m while the global thickness of the layers constitutive of cathode 1' and of grid 3 deposited on plate 10 is only about 1 to 5 $\mu$m.

The embodiment shown in FIG. 2 also applies to a monochrome screen. In this case, all strips of phosphor elements of anode 5' are of a same color and each strip is associated with a column of cathode 1' similar to a sub-column described hereabove for a color screen.

According to the present invention, advantage is taken of the fact that the ions (dotted lines in FIG. 2) emitted by the phosphor elements of the anode are less easily deviated than the electrons (full lines in FIG. 2) emitted by microtips 2. Thus, the ions are essentially collected by conductive strips 14.

An advantage of the present invention is that by suppressing a source of pollution of microtips 2, the lifetime of the screen is considerably improved.

Another advantage of the present invention is that it improves the quality of an unswitched anode screen by avoiding a parasitic illumination of phosphor elements corresponding to pixels or to sub-pixels neighboring a considered pixel. Indeed, the areas (strips) of deviation grid 15 which are parallel to the strips of phosphor elements prevent the electrons meant for a given strip of phosphor elements from bombarding a neighboring strip of phosphor elements by pushing back these electrons to the strip for which they are meant. Besides, in the preferred embodiment of deviation grid 15, the present invention further improves the quality of the screen, especially under high inter-electrode voltage, by providing a focusing effect of the electrons towards the pixels or the sub-pixels for which they are meant.

It should be noted that the first embodiment shown in FIG. 2 also applies to the case where the strips of phosphor elements are alternatively biased color per color (switched anode screen). In this case, deviation grid 15 can be omitted since the electrons are attracted by the closest biased strip of phosphor elements which corresponds to that associated with the addressed sub-column of the column, while the two other strips framing on both sides the biased strip of phosphor elements are at a zero potential. It will be however be preferred to take advantage of the focusing effect of grid 15 to prevent any risk of seeing electrons energizing the strip of phosphor elements of same color closest to that with which the sub-column from which the electrons originate is associated. Indeed, although separated by two unbiased strips, this closest strip of same color is itself biased.

Figure 3:
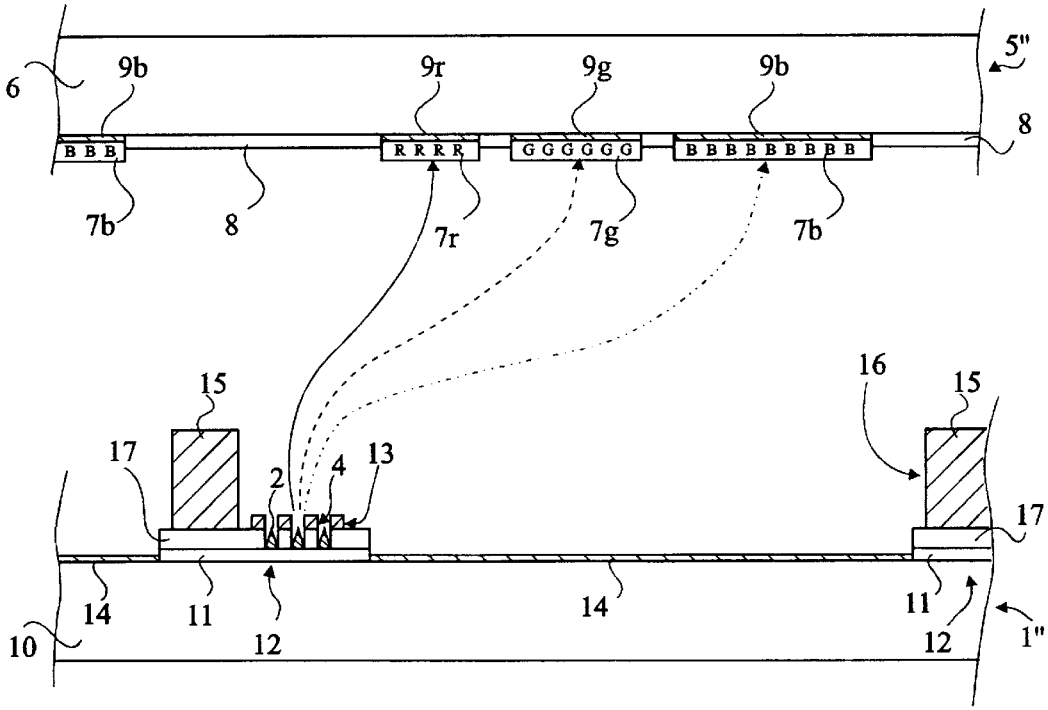
FIG. 3 shows, in cross-sectional view, a second embodiment of a flat display microtip screen according to the present invention.

FIG. 3 shows a second embodiment of a flat display microtip screen according to the present invention. This embodiment applies to a color screen.

According to this embodiment, each column of cathode 1" is implemented in a way similar to a sub-column of the embodiment described in relation with FIG. 2. On the side of anode 5", three strips of phosphor elements 7*r*, 7*g*, and 7*b* are associated with each column 12 of cathode 1". Each column 12 is, according to this embodiment, meant to bombard alternatively (for example, according to a display mode performed by sub-frames respectively associated with each color) the strips of phosphor elements of each of the colors. A pixel is here defined by the intersection of a line of grid 3 with a column 12 of cathode 1" and a group of three neighboring strips of anode 5". Each conducting strip 14 meant to collect the ions emitted by the phosphor elements of anode 5" extends, in width, under the three strips 7*r*, 7*g*, and 7*b* associated with the corresponding column 12, and can be biased independently from columns 12. The holes 13 of extraction grid 3 and the holes 16 of deviation grid 15 are adapted to the global width of the three strips 7*r*, 7*g*, and 7*b*.

In this embodiment, deviation grid 15 is biased to a different potential for each of the colors according to the strip 7*r*, 7*g*, or 7*b* which is to be energized. The biasing potential of grid 15 is chosen, according to the color, among three values included, for example, between −50 and −200 volts, the potential associated with the closest strip of phosphor elements being the least negative potential.

In the embodiment shown in FIG. 3, strips of phosphor elements 7*r*, 7*g*, and 7*b* are deposited on electrodes, respectively 9*r*, 9*g* and 9*b*, formed of corresponding strips of a conductive layer, for example ITO, separated from one another by an insulator 8. The sets of red, green, blue strips are alternatively biased with respect to cathode 1".

However, this embodiment sometimes also applies to an anode wherein strips 7*r*, 7*g*, and 7*b* are all simultaneously biased. In this case, the modification of the biasing of grid 15 according to the color determines that of strips 7*r*, 7*g*, or 7*b* which receives the electrons.

Preferably, the strips of phosphor elements have different widths according to their position with respect to the emission area. This difference in width compensates the difference of the focusing effect linked with the three grid voltages required for the selection of a color. Given that the luminosity factor of a phosphor depends on the density of current received, and thus, for a given current, on the width of the phosphor strips, differences in width enable to balance an uneven luminosity factor between the three colors.

In the case of a screen of high inter-electrode voltage, and the phosphor elements of which are all simultaneously biased, independently from their color, the biasing of the phosphor elements of the anode can, be it in the first or in the second embodiment, be ensured by a thin metal layer (18, FIG. 2), for example, aluminum, deposited on the entire useful surface of the anode and imprisoning the strips of phosphor elements. The high energy (about 2 to 10 keV) of the electrons enables them to cross this metallization layer to energize the phosphors. However, this thin metal layer is generally not sufficiently impenetrable to avoid any ion emission from the phosphors and the present invention remains useful.

It should be noted that, in the case of an anode 5' or 5", in which all phosphor elements are simultaneously biased independently from their color, strips 7*r*, 7*g*, and 7*b* can be replaced with pellets of a size corresponding to the size of a sub-pixel. Grid 3 then is, in this case, provided with a hole 13 perpendicular to each pellet of phosphor elements.

An advantage of the present invention is that it enables to implement in a simple way a flat screen, the display surface of which is formed by plate 10 supporting cathode 1'.

According to the present invention, a screen observable through the cathode is obtained by depositing strips 14 of ion collection directly on plate 10 and by providing these strips in a transparent material, for example, ITO. Strips 14 are, preferably, interconnected to be biased together. Strips 14 are, for example, formed in the same conductive layer as the microtip biasing conductors.

Grid 15 is, for example, disposed on an insulating layer resting on the cathode/grid assembly. For example, grid 15 rests, in holes 13 provided in the lines of grid 3 and in the spaces between the lines of grid 3, upon an insulating layer 17 in the thickness of which are made microtips 2. Grid 3 can also be coated with an insulation layer (not shown) open above holes 16 of grid 15 which then rests upon this insulating layer. The practical implementation of cathode 1', of extraction grid 3, and of deviation grid 15 is within the abilities of those skilled in the art by using known techniques to respect the requirements of insulation between the conductive elements.

If the screen surface is formed by plate 6 of anode 5' or 5", ion collection layer 14 can be deposited on an insulation layer (not shown), positioned on grid layer 3 and open in the areas where grid 3 is provided with holes 4. In this case, grid layer 3 does not need to be opened by holes 13. Microtips 2 can, possibly, be present under conductive layer 14 according to the pattern following which they are deposited, but they are then made inoperative by the insulating layer which covers grid 3. Similarly, in the case of a screen where the pixels (for a monochrome screen), or the sub-pixels (for a color screen) are defined by pellets, some microtips can be masked by grid 15, outside holes 16 and thus be made inoperative. Only the microtip regions, unmasked, which are free to emit electrons to the phosphor elements form emissive regions according to the present invention.

Of course, the present invention is likely to various alterations, modifications, and improvements which will readily occur to those skilled in the art. Especially, the biasing potentials of the phosphor elements, of the microtips, of the extraction grid, and of the deviation grid will be chosen according to the functional characteristics desired for the screen. Further, the present invention also applies to a bichrome screen, the pixels of which are, on the anode side, formed of regions of phosphor elements of two different colors.

Such alterations, modifications, and improvements are intended to be part of this disclosure, and are intended to be within the spirit and the scope of the invention. Accordingly, the foregoing description is by way of example only and is not intended to be limiting. The invention is limited only as defined in the following claims and the equivalent thereto.

What is claimed is:

1. A flat display screen, including:

a cathode (1', 1") associated with a grid (3) for extracting electrons emitted by at least one region (12*r*, 12*g*, 12*b*; 12) of the cathode; and an anode (5'; 5") provided with phosphor elements (7*r*, 7*g*, 7*b*) placed facing the cathode/grid, wherein the cathode has no emissive region in the areas located above the phosphor elements, these areas including a conductive layer (14) which can be biased independently from the emissive regions.

2. The screen of claim 1, including a grid (15) for deviating the electrons emitted by each emissive region (12*r*, 12*g*, 12*b*; 12) of the cathode (1', 1") to at least one region of phosphor elements (7*r*, 7*g*, 7*b*).

3. The screen of claim 1, wherein the conductive layer (14) is biased to a potential at most equal to a minimum potential of biasing of the emissive regions (12*r*, 12*g*, 12*b*; 12).

4. The screen of claim 1, wherein the cathode (1'; 1") and the extraction grid (3) are supported by a transparent plate (10) forming the display surface of the screen, the conductive layer (14) being in a transparent material directly deposited on the plate.

5. The screen of claim 1, wherein each emissive region (12*r*, 12*g*, 12*b*) of the cathode (1') is associated with a region (7*r*, 7*g*, 7*b*) of the phosphor elements, the deviation grid (15) being biased to a potential lower than a minimum potential of biasing of the emissive regions.

6. The screen of claim 1, wherein each emissive region (12) of the cathode (1'; 1") is associated with at least two regions (7*r*, 7*g*, 7*b*) of phosphor elements, the biasing potential of the deviation grid (15) being a function of the region of the phosphor elements to be energized while being lower than a minimum biasing potential of the emissive regions.

7. The screen of claim 1, wherein all regions of the phosphor elements (7*r*, 7*g*, 7*b*) of the anode (5'; 5") are simultaneously biased.

8. The screen of claim 1, wherein the anode (5'; 5") is formed of at least two sets of alternate strips (7*r*, 7*g*, 7*b*) of the phosphor elements, each set of strips being individually biased.

9. The screen of claim 1, wherein the cathode (1'; 1") is organized in columns (12*r*, 12*g*, 12*b*; 12), the extraction grid (3) being organized in lines and each intersection of a line of the extraction grid with a column of the cathode defining an emissive region.

10. The screen of claim 1, wherein the emissive regions are formed of microtips (2).

* * * * *